US010953271B2

(12) United States Patent
Marchetti

(10) Patent No.: US 10,953,271 B2
(45) Date of Patent: Mar. 23, 2021

(54) EXERCISE MAT WITH INTEGRATED CARRY STRAP ARRANGEMENT

(71) Applicant: Rebecca N. Marchetti, Bronxville, NY (US)

(72) Inventor: Rebecca N. Marchetti, Bronxville, NY (US)

( * ) Notice: Subject to any disclaimer, the term of this patent is extended or adjusted under 35 U.S.C. 154(b) by 305 days.

(21) Appl. No.: 16/155,020

(22) Filed: Oct. 9, 2018

(65) Prior Publication Data

US 2020/0108289 A1 Apr. 9, 2020

(51) Int. Cl.
*A63B 21/00* (2006.01)
*A63B 71/00* (2006.01)

(52) U.S. Cl.
CPC ..... *A63B 21/4037* (2015.10); *A63B 71/0036* (2013.01); *A63B 2210/50* (2013.01)

(58) Field of Classification Search
CPC ..... A63B 21/4037; A63B 71/0036; A63B 2210/50; A63B 2209/00; A63B 2225/09; A45F 3/14
See application file for complete search history.

(56) References Cited

U.S. PATENT DOCUMENTS 1,237,243 A * 8/1917 Conner ..... A47C 27/001 5/420
3,161,931 A 12/1964 Zif
4,905,990 A * 3/1990 DeSantis ..... A63B 6/00 482/148
5,265,292 A * 11/1993 Underell ..... A47C 4/52 297/380
5,730,529 A * 3/1998 Fritz ..... A45C 3/10 224/153
6,374,418 B1 4/2002 Rindle
D478,455 S * 8/2003 Papazian ..... A63B 21/02 D6/596
6,640,359 B1 * 11/2003 Alane ..... A47G 27/0237 5/417
6,751,816 B1 * 6/2004 Wechsler ..... A45F 3/14 383/4
7,007,322 B2 * 3/2006 Alane ..... A47G 27/0237 5/417
7,485,071 B2 * 2/2009 Edwards ..... A63B 21/4037 482/23
7,657,952 B2 * 2/2010 Hutchison ..... A47G 9/062 5/420
D657,987 S * 4/2012 Lane ..... A47G 27/0237 D6/582

(Continued)

*Primary Examiner* — David R Hare
(74) *Attorney, Agent, or Firm* — Leason Ellis LLP

(57) ABSTRACT

An exercise mat having storage and transportation features is provided. The mat has a first strap having first and second ends is attached to the bottom face of the mat. A pocket is defined between a middle section of the first strap and the bottom face of the mat. A second strap having first and second ends is attached to the bottom face of the mat adjacent the first strap. A loop is defined by a middle section of the second strap between the first and second attached ends. The mat is capable of being rolled into a rolled configuration, and wherein the loop is sized and shaped such that in the rolled configuration the loop can wrap around the rolled mat and through the pocket to form a cinch, and loop is capable of being used to carry the mat.

14 Claims, 9 Drawing Sheets

(56) References Cited

U.S. PATENT DOCUMENTS

| | | | | |
|---|---|---|---|---|
| 8,454,484 | B2 * | 6/2013 | Keen | A63B 21/02 482/92 |
| 8,607,381 | B2 * | 12/2013 | Woods | A47G 27/0237 5/420 |
| D721,410 | S * | 1/2015 | Curley | A47C 4/52 D21/662 |
| D884,342 | S * | 5/2020 | Savino Ben | A47C 27/001 D3/254 |
| 2004/0250346 | A1 * | 12/2004 | Vasishth | A47G 27/0237 5/417 |
| 2005/0192158 | A1 * | 9/2005 | Edwards | A63B 6/00 482/23 |
| 2006/0160672 | A1 * | 7/2006 | Appleby | A45F 3/14 482/84 |
| 2008/0116239 | A1 * | 5/2008 | Lu | A45F 3/14 224/575 |
| 2011/0131723 | A1 * | 6/2011 | Andrews | A63B 21/0004 5/417 |
| 2019/0134484 | A1 * | 5/2019 | Bova | A45F 3/14 |

* cited by examiner

EXERCISE MAT WITH INTEGRATED CARRY STRAP ARRANGEMENT

FIELD OF THE INVENTION

The present invention concerns an exercise mat and, more particularly, an exercise mat having an integrated carry strap arrangement.

BACKGROUND OF THE INVENTION

Exercise mats are typically made from a foam cushion and can be used for a number of different floor exercises. One application is use in connection with yoga exercises, and, in this context, are commonly referred to as "yoga mats." Transporting the mat (e.g., to and from the gym) typically involves rolling the flat mat into a roll and placing the rolled mat in a carry bag. Sometimes straps are applied to the rolled mat to maintain the mat in a rolled shape. An additional strap can be provided for use in carrying the rolled mat over a user's shoulder so that the mat can be more easily carried and transported. This arrangement of straps to secure the mat in a rolled condition and additional straps for carrying the bag are in lieu of a separate carry bag.

Several issues exist with typical existing straps including multiple separate parts and finagling that are needed to place the mat in condition for transporting, and for storing and flattening straps when the mat is ready to be unrolled and placed into service. For example, certain straps will completely detach from the mat upon unrolling of the mat, which can lead to loss of the straps and/or require separate storage of the straps when not in use. In other strap systems separate snaps or fasteners are required to secure the mat in a rolled condition, which can require a user to simultaneously try to maintain the mat in the rolled condition while also securing the straps. This can be difficult to do and lead to inadvertent unrolling of the mat and/or poor attachment of the straps. In addition, certain straps can be used to secure a mat in a rolled condition, but do not provide a convenient means for carrying the mat. Accordingly, a user may have to carry the mat in a hand or under a shoulder, which can be cumbersome, especially when trying to carry other items, open doors, access a car, etc.

The present invention, as described herein, addresses these and other issues.

SUMMARY OF THE INVENTION

In one aspect of the invention, an exercise mat having integrated storage and transportation features is provided. A mat has a top face and a bottom face, a first end and a second end, a first edge and a second edge, and a first side and a second side separated from each other by a single layer of flexible material which defines the mat. A first strap having first and second ends is attached to the bottom face of the mat. A pocket is defined between a middle section of the first strap and the bottom face of the mat. A second strap having first and second ends is attached to the bottom face of the mat adjacent the first strap. A loop is defined by a middle section of the second strap between the first and second attached ends, the loop being freely movable relative to the mat. The mat is rollable into a rolled configuration and the loop is sized and shaped such that, in the rolled configuration, the loop is wrappable around the rolled mat and passable through the pocket to define a cinch. The cinched loop provides a handle to carry the mat.

According to a further aspect, the middle section of the first strap has a length that is approximately equal to a distance between the attachment points of the first and second ends of the first strap.

According to a still further aspect, the middle section of the second strap has a length that is approximately twice a distance between the attachment points of the first and second ends of the second strap.

According to a yet further aspect, the first and second ends of the first strap extend generally parallel to the first edge of the mat and the first and second ends of the second strap extend at an angle with respect to the first edge of the mat, wherein the freely movable loop extends away from the mat at the angle.

According to a further aspect, the first and second ends of the first strap extend to the top face of the mat to provide reinforcement tabs which are attached to the top face of the mat.

According to a still further aspect, the first and second ends of the second strap extend to the top face of the mat to provide reinforcement tabs which are attached to the top face of the mat.

According to another aspect, an exercise mat having storage and transportation features is provided. A mat has a top face and a bottom face, a first end and a second end, a first edge and a second edge, and a first side and a second side separated from each other by a single layer of flexible material which defines the mat. A first strap having first and second ends is attached to the bottom face of the mat. First and second pocket are defined between a first and second portion of a middle section of the first strap and the bottom face of the mat. A second strap passes through the first and second pockets. A first loop is defined by a first portion the second strap between the first and second pockets, the first loop being freely movable relative to the mat. A second loop is defined by a second portion the second strap between the first and second pockets, the second loop being freely movable relative to the mat. The mat is rollable into a rolled configuration, and the first and second loops are sized and shaped such that, in the rolled configuration, one of the loops is wrappable around the rolled mat and passable through the other loop to define a cinch. The cinched loop provides a handle to carry the mat.

According to a further aspect, the middle section of the second strap is free to slide through the pocket such that the respective size of the first and second loops can be adjusted.

According to a still further aspect, the first and second ends of the first strap extend generally parallel to the first edge of the mat.

According to a yet further aspect, the first and second ends of the first strap extend to the top face of the mat to provide reinforcement tabs which are attached to the top face of the mat.

According to another aspect, a method of converting an exercise mat into a storage and transportation configuration is provided. The method steps include rolling a mat. The mat includes a top face and a bottom face, a first end and a second end, a first edge and a second edge, and a first side and a second side separated from each other by a single layer of flexible material which defines the mat. A first strap having first and second ends is attached to the bottom face of the mat. A pocket is defined between a middle section of the first strap and the bottom face of the mat. A second strap having first and second ends is attached to the bottom face of the mat adjacent the first strap. A loop is defined by a middle section of the second strap between the first and second attached ends, the loop being freely movable relative to the mat. The method further includes the step of wrapping the loop around the rolled mat. The loop is passed through the pocket to define a cinch, wherein the cinched loop provides a handle to carry the mat.

These and other features and advantages will be apparent from the following description of certain embodiments of the invention when considered in conjunction with the drawing figures which illustrate the embodiments described herein, but which are not intended to be limiting of the scope of the invention claimed.

DETAILED DESCRIPTION CERTAIN OF EMBODIMENTS OF THE INVENTION

Figure 1:
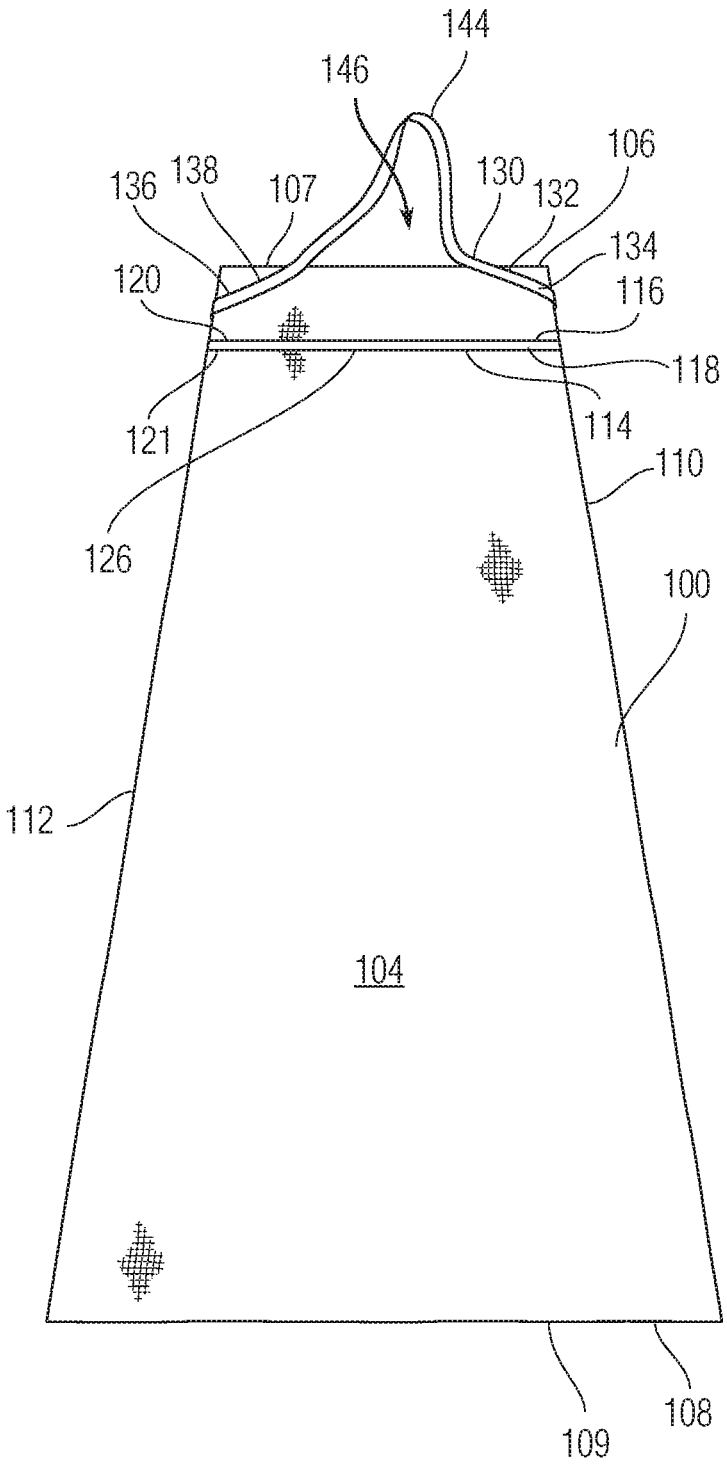
FIG. 1 shows a bottom view an exercise mat in an unrolled configuration in accordance with one embodiment of the present invention.
Figure 2:
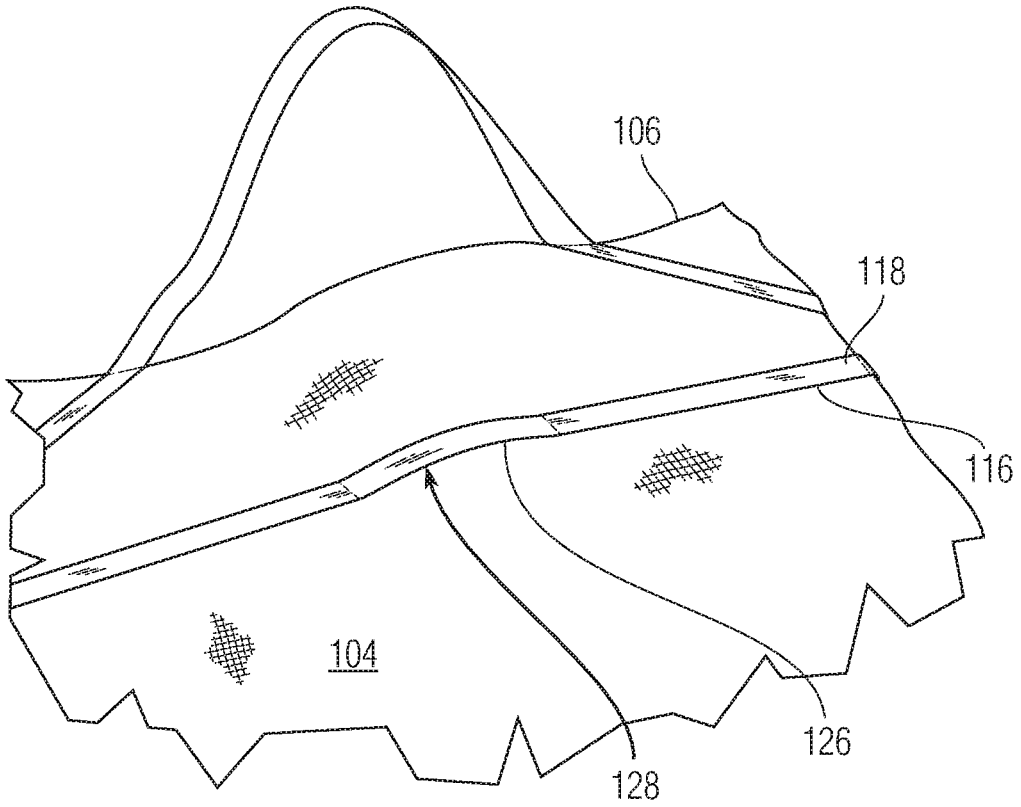
FIG. 2 shows a partial, close-up bottom view of the mat of FIG. 1.

Referring to FIGS. 1-4, an embodiment is illustrated of an exercise mat or yoga mat 100 with integrated straps. The yoga mat 100 is generally a flat sheet of foam rubber or other material that is typically used for yoga and exercise mats and the like. The yoga mat 100 has a top face 102 and a bottom face 104, a first end 106 and a second end 108, a first edge 107 and a second edge 109, and a first side 110 and a second side 112. The first and second sides are separated from each other by a single layer of flexible material which defines the mat. The single layer of material (e.g., foam rubber) extends to the exterior top and bottom faces 102, 104 in certain embodiments. In other embodiments, a second material can be adhered to the mat, or a different durometer layer can be otherwise provided (e.g., formed with a principal layer of the mat) to provide a top or bottom surface which differs from the remainder of the mat. The second material can be chosen to impart particular properties to the mat, such as traction, moisture resistance, comfort, and so on.

A first strap 114 is provided at the first end 106 of the yoga mat 100. The first strap 114 preferably has a flat, wide configuration and is attached such that a first end 116 of the first strap 114 is attached at a first attachment point 118 to the bottom face 104 of the yoga mat adjacent the first side 110 of the yoga mat 100. A second end 120 of the first strap 114 is attached at a second attachment point 121 to the bottom face 104 adjacent the second side 112 of the yoga mat 100. The attachments make the ends of the first strap immovable. The first strap 114 can be sized and shaped such that the first end 116 and second end 120 of the strap 114 are long enough to extend around the first and second sides 110, 112, respectively, and wrap to the top face 102 of the mat to define reinforcing tabs 122 and 124. The reinforcing tabs 122 and 124 can be attached to the top face 102 of the mat. In the configuration in which the strap ends 116 and 120 wrap to the top face 102, the tabs 122 and 124 can be attached by, for example, stitching, such that the stitching extends through the tabs 122, 124, through the portions of the yoga mat 100 disposed between the tabs 122, 124 and the strap ends 116, 120, respectively, and the first and second ends 116, 120 themselves. Attaching the tabs to the strap ends (e.g., by stitching) with a portion of the yoga mat disposed therebetween provides a strong and durable structure for attachment. In alternative embodiments, the ends of the first strap do not extend around the opposite sides of the mat. This is desirable to minimize the effect of the strap attachment on a person using the mat by eliminating any strap attachment on the top surface of the mat when placed into service.

A middle section 126 of the strap 114 is not directly attached to the bottom face 104 of the yoga mat 100. The middle section 126 of the strap 114 has a length that is equal to, or slightly greater than (e.g., about ten to thirty percent greater), the distance between the first and second attachment points 118, 121. With the middle section 126 of the strap not directly attached to the yoga mat, a pocket 128 is defined between the middle section 126 of the strap and the bottom face 104 of the yoga mat. The pocket 128 is discussed in further detail below. The first strap 114 can be attached to the yoga mat 100 such that the first strap 114 is generally parallel to the first edge 107 of the mat 100.

A second strap 130 is provided at the first end 106 of the yoga mat 100 and disposed proximate the first strap 114. The second strap 130 is attached to the first end 106 of the yoga mat 100 between the first strap 114 and the first edge 107 of the mat 100. The second strap 130 preferably has a flat, wide configuration and is attached such that a first end 132 of the second strap 130 is attached at a first attachment point 134 to the bottom face 104 of the yoga mat adjacent the first side 110 of the yoga mat 100. A second end 136 of the second strap 130 is attached at a second attachment point 138 to the bottom face 104 adjacent the second side 112 of the yoga mat 100. The attachments make the ends of the second strap immovable. The second strap 130 can be sized and shaped such that the first end 132 and second end 136 of the strap 130 are long enough to extend around the first and second sides 110, 112, respectively, and wrap to the top face 102 of the mat to define reinforcing tabs 140 and 142. The reinforcing tabs 140 and 142 can be attached to the top face 102 of the mat. In the configuration in which the strap ends 132 and 136 wrap to the top face 102, the tabs 140 and 142 can be attached by, for example, stitching, such that the stitching extends through the tabs 140, 142, through the portions of the yoga mat 100 disposed between the tabs 140, 142 and the strap ends 132, 136, respectively, and the first and second ends 132, 136 themselves. Attaching the tabs to the strap ends (e.g., by stitching) with a portion of the yoga mat disposed therebetween provides a strong and durable structure for attachment.

A middle section 144 of the second strap 130 is not directly attached to the bottom face 104 of the yoga mat 100. The middle section 144 of the strap 130 has a length that is greater than (e.g., about two to three times greater), the distance between the first and second attachment points 134, 138. With the middle section 144 of the second strap not directly attached to the yoga mat and having a large free length relative to the distance between the attachment points, a loop 146 is defined. The loop is freely movable relative to the mat. The loop 146 is discussed in further detail below. The second strap 130 can be attached to the yoga mat 100 such that the first and second ends 132, 136 are generally at an angle with respect to the first edge 107 of the mat 100. The freely movable loop extends away and emerges from the mat at substantially the same angle as the attachment of the first and second ends 132, 136.

Figure 3:
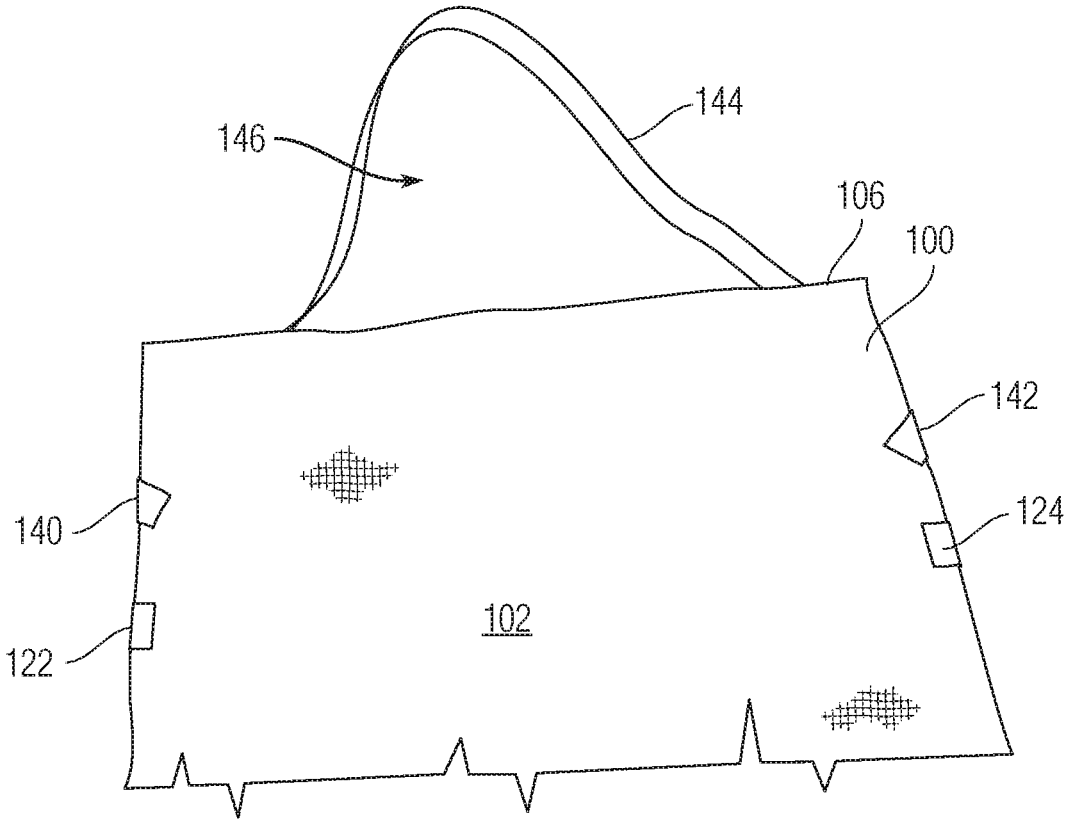
FIG. 3 shows a partial, close-up top view of the mat of FIG. 1.
Figure 4:
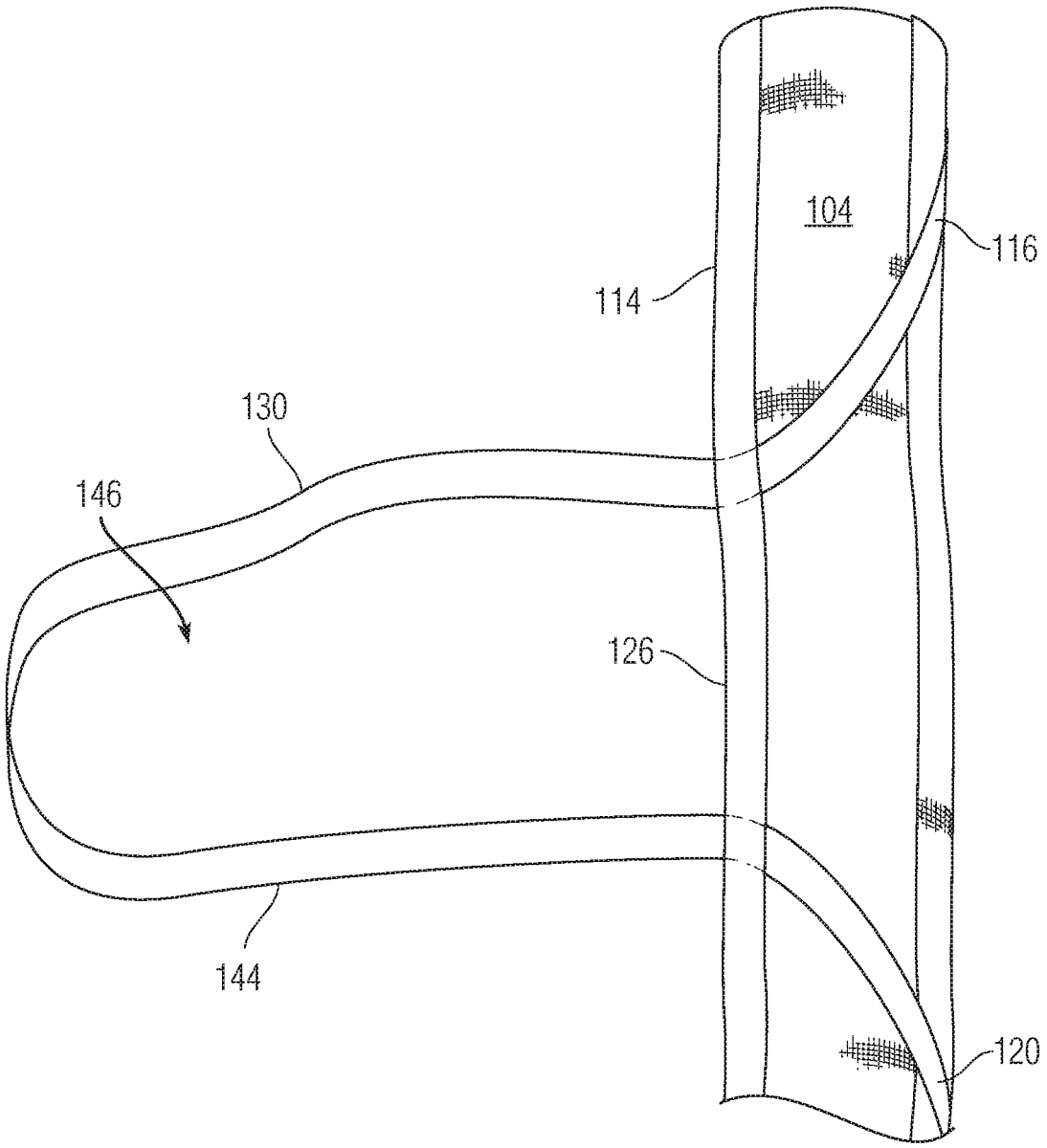
FIG. 4 shows the mat of FIG. 1 in a rolled configuration.
Figure 5:
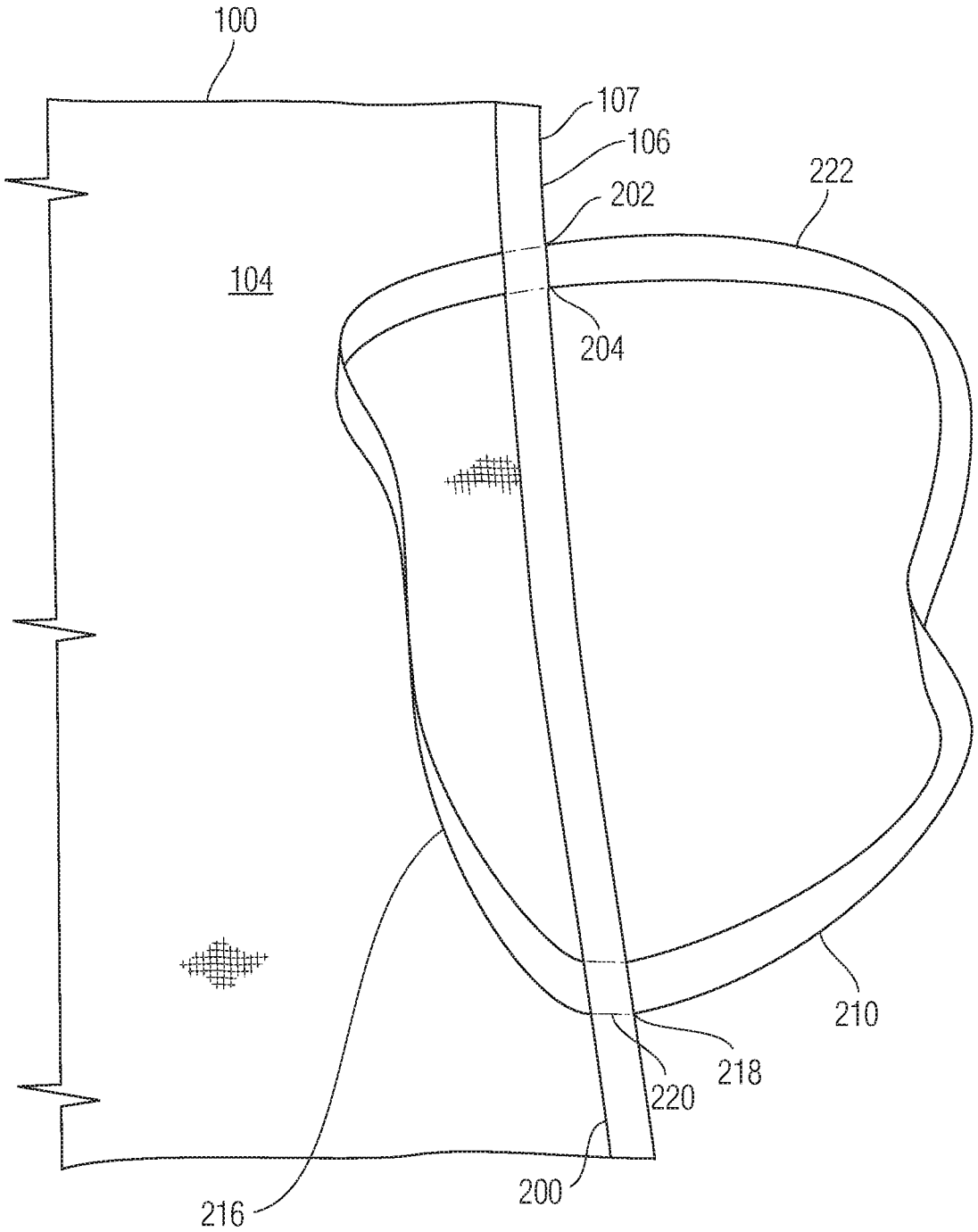
FIG. 5 shows a partial bottom view an exercise mat in an unrolled configuration in accordance with another embodiment of the present invention.
Figure 6:
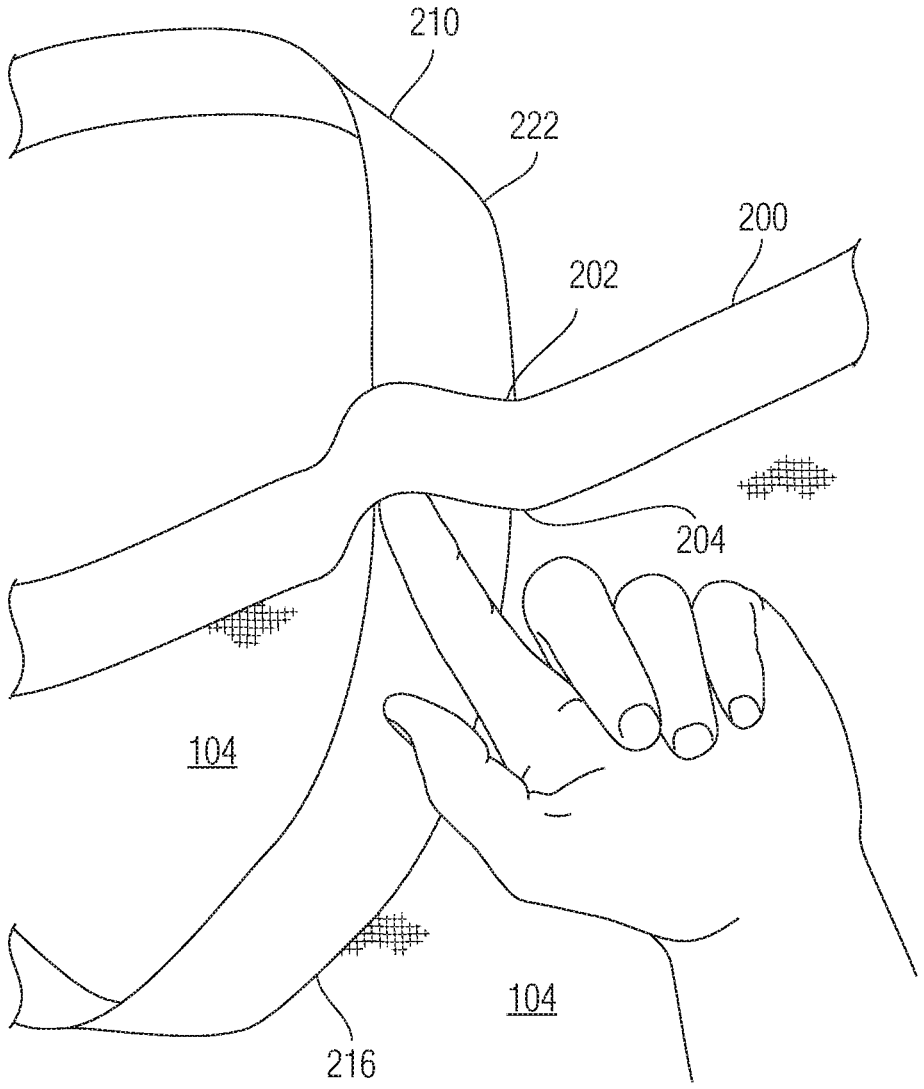
FIG. 6 shows a partial, close-up bottom view of the mat of FIG. 5.

The first and second straps 114, 130 can be used to store and transport the yoga mat 100 free of any further, separate strap or carry bag. In one exemplary method of use, the yoga mat 100 can be disposed on a floor in an unrolled, flat configuration with the top face 102 pointing upward and the bottom face 104 resting against the floor. In this flat configuration (e.g., as shown in FIG. 3), the yoga mat 100 can be used in a conventional way. In order to store and transport the yoga mat 100, the yoga mat 100 is rolled starting at the second end 108 of the mat with the top surface 102 of the mat facing on the inside of the roll. As the mat is rolled toward the first end 106 of the mat and the mat is now in a rolled configuration (e.g., as shown in FIG. 4), the middle section 144 of the second strap 130 is wrapped about the rolled mat and then passed through the pocket 128 defined by the first strap 114. By wrapping the middle section 144 of the second strap 130 about the rolled mat and passing it through the pocket 128, a cinch is formed by the loop that maintains the mat in the rolled configuration. Applying a pulling force on the middle section 144 of the second strap 130 makes the cinch tighter, which helps to maintain the mat in a tight rolled configuration for storage and transport. The so-cinched loop 146 of the second strap 130 provides a handle which is usable by a user to hold (e.g., by hand or worn over a shoulder) and transport the mat in the stored, rolled configuration. The holding of the mat by the middle section 144 applies a pulling force that helps maintain the cinch. As such, the cinch can be further maintained during transport.

Optionally, a clip or other restraint can be slideably located on one or both of the straps and be securely positioned by sliding and locking into position in order to restrain unrolling of the mat. Clips of this nature are conventional, and in and of themselves are not part of the present invention. As two non-limiting examples, see U.S. Pat. Nos. 3,161,931 and 6,374,418, the entireties of which are hereby incorporated by reference. As can be appreciated, the embodiments as illustrated omit structural hardware elements, and this is a preferred construction for use of the mat in quiet environments such as yoga studios in which the presence of hardware on the straps could result in clanking or other noise when such hardware touches hardwood floors. Noise such as that can disrupt a session, and the hardware is prone to scuffing the floor (users typically remove shoes before entering such spaces), particularly if it is under the mat and the mat is slid into a different position. Also, the absence of hardware means that there are no rigid elements in the vicinity of the matt which can cause pain if inadvertently stepped upon them. Likewise, the hardware is less desirable because rolling the mat to accommodate clasps and buckles can be difficult. Thus, while a clip or other restraint can be provided, it is attendant with negatives that are avoided by the illustrated construction.

To convert the mat back into a usable configuration, the middle section 144 of the second strap 130 is removed from the pocket 128 and the mat is unrolled into the flat configuration. The straps being attached to the mat leave no separate parts to store or later gather. The first and second straps have a flat configuration in order to minimize any tactile impact on a user when the mat is in service.

Referring to FIGS. 5-9, the yoga mat 100 is shown with another arrangement of integrated straps which can be of the same construction as discussed above. A first strap 200 is provided at the first end 106 of the yoga mat 100 along the first edge 107. The first strap 200 can be attached to the bottom face 104 of the mat along most of its length to the yoga mat 100 except for a first free portion 202 and second free portion 218 of the strap 200 that are unattached to the mat. The attachments make the ends of the first strap immovable. The first free portion 202 defines a first pocket 204 between the strap 200 and the bottom face 104 of the mat. The second free portion 218 defines a second pocket 220 between the strap 200 and the bottom face 104 of the mat. The pockets 204, 220 can be approximately the size of the width of the strap 200.

A second strap 210 is provided at the first end 106 of the yoga mat 100 and disposed proximate to the first strap 200. The second strap 210 is provided as a loop. The second strap 210 passes through the pockets 204, 220 of the first strap 200. Accordingly, a first loop 216 is defined by the second strap 210 between the first and second pockets 204, 220 on a first side of the first strap 200. A second loop 222 is defined by the second strap 210 between the first and second pockets 204, 220 on a second side of the first strap 200. The first and second loops are freely movable relative to the mat since the strap material can pass through the respective pockets, as discussed in more detail below.

The second strap 210 is free to pass through the pockets 204, 220 such that the relative size of the first and second loops 216, 222 can be adjusted by pulling more or less of the second strap 210 through the pockets 204, 220. For example, pulling on the second strap 210 in a first direction can result in the size of the second loop 222 increasing while simultaneously decreasing the size of the first loop 216, and vice-versa. In certain configurations, the second loop 222 can be relatively large and the first loop 216 relatively small such that the second loop can be used as a shoulder carrying strap (see, e.g., FIG. 8). In other configurations, the first and second loops 216, 222 can be relatively the same size and used as carrying handles (see, e.g., FIG. 9).

Figure 7:
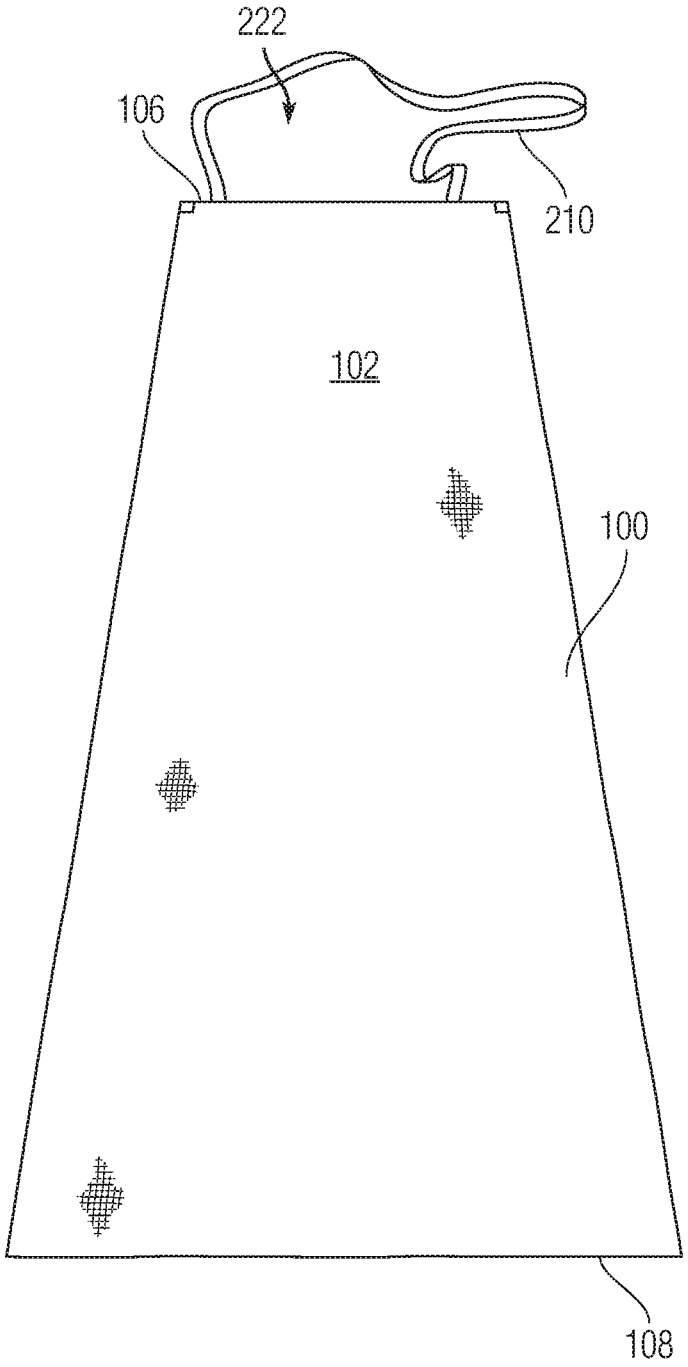
FIG. 7 shows a top view of the mat of FIG. 5.
Figure 8:
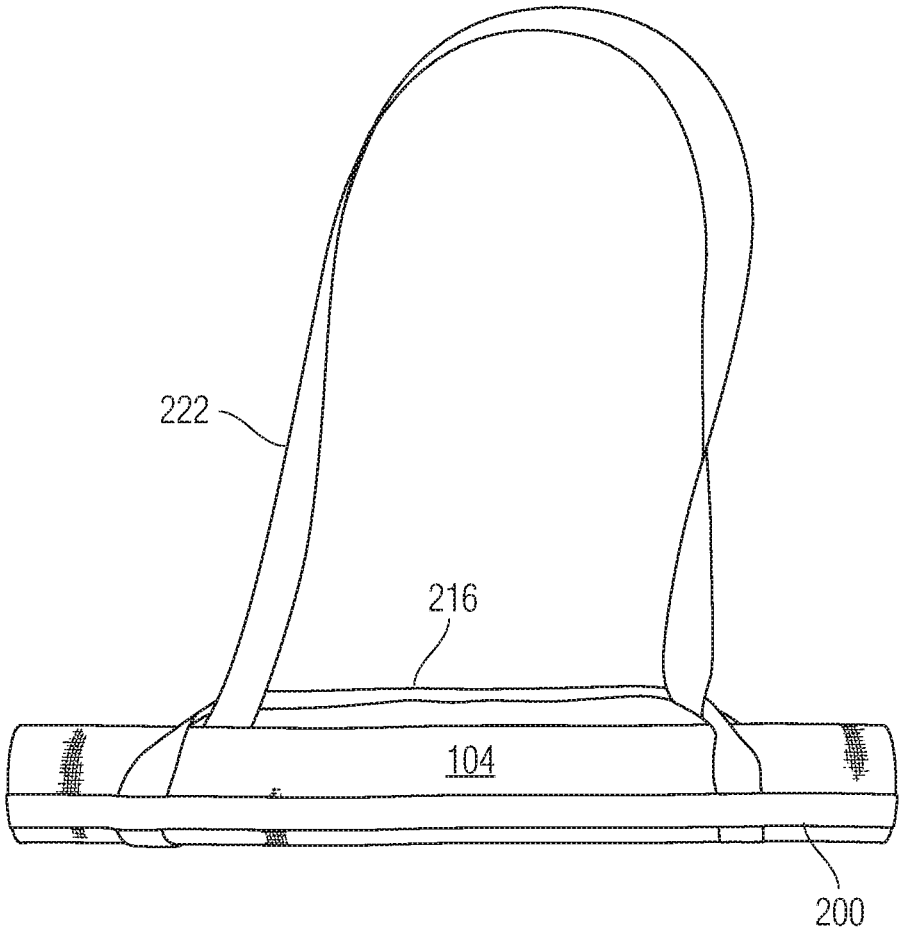
FIG. 8 shows the mat of FIG. 5 in a rolled configuration with the straps in a first configuration.

The first and second loops 216, 222 of the second strap 210 can be used to store and transport the yoga mat 100 free of any further, separate strap or carry bag. In one exemplary method of use, the yoga mat 100 can be disposed on a floor in an unrolled, flat configuration with the top face 102 pointing upward and the bottom face 104 resting against the floor. In this flat configuration (e.g., as shown in FIG. 7), the yoga mat 100 can be used in a conventional manner. In order to store and transport the yoga mat 100, the yoga mat 100 is rolled starting at the second end 108 of the mat with the top surface 102 of the mat facing on the inside of the roll. As the mat is rolled toward the first end 106 of the mat and the mat is now in a rolled configuration (e.g., as shown in FIG. 8). Then one of the first and second loops 216, 222 can be wrapped about the rolled mat and then passed through the other of the first and second loops defined by the second strap 210 to form a cinch. By wrapping one of the loops about the rolled mat and through the other loop, a cinch is formed that maintains the mat in the rolled configuration. Applying pulling force on the loop that has been passed through the other makes the cinch tighter, which helps to maintain the mat in a tight rolled configuration for storage and transport.

As noted above, optionally, a clip or other restraint can be slideably located on one or both of the straps and be securely positioned by sliding and locking into position in order to restrain unrolling of the mat. Clips of this nature are conventional, and in and of themselves are not part of the present invention and can be of the construction of the aforementioned patents that have been incorporated by reference.

Figure 9:
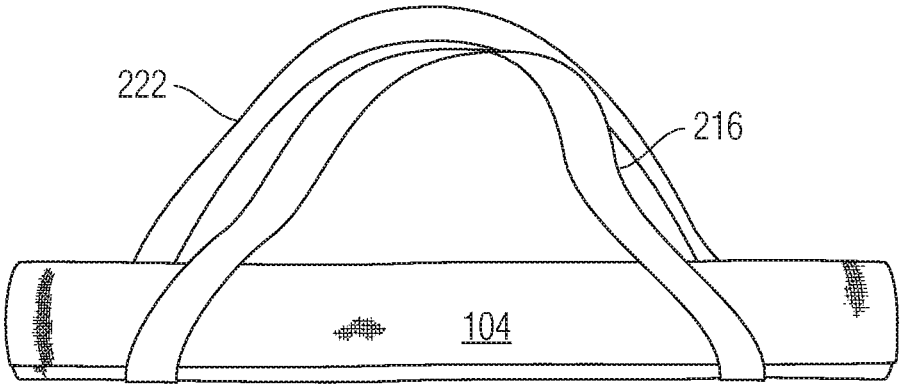
FIG. 9 shows the mat of FIG. 5 in a rolled configuration with the straps in a second configuration.

As shown in FIG. 8, one of the loops can be longer than the other and can be used by a user to hold (e.g., worn over a shoulder) and transport the mat in the stored, rolled configuration. As shown in FIG. 9, both loops can be approximately the same size and can be used by a user to hold (e.g., held by a hand) and transport the mat in the stored, rolled configuration.

To convert the mat back into a usable configuration, the loops 216, 222 are uncrossed such that one loop is no longer passing through the other and then the mat is unrolled into the flat configuration.

Accordingly, an efficient and convenient strap system is integrated with a mat and provides a cinch mechanism which helps to maintain the mat in a tightly rolled configuration, and which concurrently defines carrying straps. This structural arrangement provides advantages over other systems in which separate straps or bags are required to maintain the mat in a rolled configuration and for carrying the mat.

The subject matter described above is provided by way of illustration only and should not be construed as limiting. Various modifications and changes can be made to the subject matter described herein without following the example embodiments and applications illustrated and described, and without departing from the true spirit and scope of the present invention. For example, the present invention can also be applied to other types of exercise mats, play mats, sleeping mats, etc.

Notably, the figures and examples above are not meant to limit the scope of the present application to a single implementation, as other implementations are possible by way of interchange of some or all of the described or illustrated elements. Moreover, where certain elements of the present application can be partially or fully implemented using known components, only those portions of such known components that are necessary for an understanding of the present application are described, and detailed descriptions of other portions of such known components are omitted so as not to obscure the application. In the present specification, an implementation showing a singular component should not necessarily be limited to other implementations including a plurality of the same component, and vice-versa, unless explicitly stated otherwise herein. Moreover, applicants do not intend for any term in the specification or claims to be ascribed an uncommon or special meaning unless explicitly set forth as such. Further, the present application encompasses present and future known equivalents to the known components referred to herein by way of illustration.

The foregoing description of the specific implementations will so fully reveal the general nature of the application that others can, by applying knowledge within the skill of the relevant art(s) (including the contents of the documents cited and incorporated by reference herein), readily modify and/or adapt for various applications such specific implementations, without undue experimentation, without departing from the general concept of the present application. Such adaptations and modifications are therefore intended to be within the meaning and range of equivalents of the disclosed implementations, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s). It is to be understood that dimensions discussed or shown in drawings are shown accordingly to one example and other dimensions can be used without departing from the invention.

While various implementations of the present application have been described above, it should be understood that they have been presented by way of example, and not limitation. It would be apparent to one skilled in the relevant art(s) that various changes in form and detail could be made therein without departing from the spirit and scope of the application. Thus, the present application should not be limited by any of the above-described example implementations.

The invention claimed is:

1. An exercise mat having integrated storage and transportation features, comprising:

a mat having a top face and a bottom face, a first end and a second end, a first edge and a second edge, and a first side and a second side separated from each other by a single layer of flexible material which defines the mat;

a first strap having first and second ends attached to the bottom face of the mat;

a pocket defined between a middle section of the first strap and the bottom face of the mat;

a second strap having first and second ends attached to the bottom face of the mat adjacent the first strap; and a loop defined by a middle section of the second strap between the first and second attached ends, the loop being freely movable relative to the mat;

wherein the mat is rollable into a rolled configuration, and wherein the loop is sized and shaped such that, in the rolled configuration, the loop is wrappable around the rolled mat and passable through the pocket to define a cinched loop, and wherein the cinched loop provides a handle to carry the mat; and wherein the first and second ends of the first strap extend generally parallel to the first edge of the mat and the first and second ends of the second strap extend at an angle with respect to the first edge of the mat, wherein the freely movable loop extends away from the mat at the angle.

2. The exercise mat of claim 1, wherein the middle section of the first strap has a length that is approximately equal to a distance between the attachment points of the first and second ends of the first strap.

3. The exercise mat of claim 1, wherein the middle section of the second strap has a length that is approximately twice a distance between the attachment points of the first and second ends of the second strap.

4. The exercise mat of claim 1, wherein the first and second ends of the first strap extend to the top face of the mat to provide reinforcement tabs which are attached to the top face of the mat.

5. The exercise mat of claim 1, wherein the first and second ends of the second strap extend to the top face of the mat to provide reinforcement tabs which are attached to the top face of the mat.

6. An exercise mat having storage and transportation features, comprising:

a mat having a top face and a bottom face, a first end and a second end, a first edge and a second edge, and a first side and a second side separated from each other by a single layer of flexible material which defines the mat;

a first strap having first and second ends attached to the bottom face of the mat;

a first and second pocket defined between a first and second portion of a middle section of the first strap and the bottom face of the mat;

a second strap passing through the first and second pockets;

a first loop defined by a first portion the second strap between the first and second pockets, the first loop being freely movable relative to the mat;

a second loop defined by a second portion the second strap between the first and second pockets, the second loop being freely movable relative to the mat; and wherein the mat is rollable into a rolled configuration, and wherein the first and second loops are sized and shaped such that, in the rolled configuration, one of the loops is wrappable around the rolled mat and passable through the other loop to define a cinched loop, and wherein the cinched loop provides a handle to carry the mat.

7. The exercise mat of claim 6, wherein the middle section of the second strap is free to slide through the first and second pockets such that the respective size of the first and second loops can be adjusted.

8. The exercise mat of claim 6, wherein the first and second ends of the first strap extend generally parallel to the first edge of the mat.

9. The exercise mat of claim 6, wherein the first and second ends of the first strap extend to the top face of the mat to provide reinforcement tabs which are attached to the top face of the mat.

10. A method of converting an exercise mat into a storage and transportation configuration, comprising the steps of:

rolling a mat, the mat comprising:

a top face and a bottom face, a first end and a second end, a first edge and a second edge, and a first side and a second side separated from each other by a single layer of flexible material which defines the mat;

a first strap having first and second ends attached to the bottom face of the mat, the first and second ends of the first strap extending generally parallel to the first edge of the mat;

at least one pocket defined between a middle section of the first strap and the bottom face of the mat;

a second strap disposed proximate the first strap, the second strap having first and second ends that extend at an angle with respect to the first edge of the mat; and at least one loop defined by at least a first portion of a middle section of the second strap, the at least one loop being freely movable relative to the mat and extending away from the mat at an angle;

wrapping the at least one loop around the rolled mat; and passing the at least one loop through one of the at least one pocket and a second loop to define a a cinched loop, wherein the cinched loop provides a handle to carry the mat.

11. The method of claim 10, wherein the middle section of the first strap has a length that is approximately equal to a distance between the attachment points of the first and second ends of the first strap.

12. The method of claim 10, wherein the middle section of the second strap has a length that is approximately twice a distance between attachment points of the first and second ends of the second strap to the mat.

13. The method of claim 10, wherein the first and second ends of the first strap extend to the top face of the mat to provide reinforcement tabs which are attached to the top face of the mat.

14. The method of claim 10, wherein the first and second ends of the second strap extend to the top face of the mat to provide reinforcement tabs which are attached to the top face of the mat.

* * * * *